United States Patent [19]

Gunn

[11] 4,026,549

[45] May 31, 1977

[54] ADJUSTABLE ELASTIC TYPE EXERCISING DEVICE

[76] Inventor: William L. Gunn, 560 Highpoint Lane, NE., Atlanta, Ga. 30342

[22] Filed: Dec. 29, 1975

[21] Appl. No.: 644,859

[52] U.S. Cl. ..... 272/137; 272/143; 272/142

[51] Int. Cl.[2] ..... A63B 21/02

[58] Field of Search ..... 272/142, 137, 143, 135, 272/139, 75, 74, 136

[56] References Cited

UNITED STATES PATENTS

| | | | |
|---|---|---|---|
| 886,032 | 4/1908 | Barrett | 272/139 |
| 1,651,057 | 11/1927 | Goldstein | 272/75 |
| 2,723,121 | 11/1955 | Cartwright et al. | 272/75 |
| 3,256,015 | 6/1966 | Perrin | 272/137 X |
| 3,652,085 | 5/1972 | Cole | 272/136 |
| 3,677,543 | 7/1972 | Richardson | 272/136 |

*Primary Examiner*—Richard J. Apley
*Assistant Examiner*—William R. Browne
*Attorney, Agent, or Firm*—John H. Merchant

[57] ABSTRACT

A portable elastic type exercising device which may be carried on the person for strengthening and developing the muscles of the arms and limbs, and more especially the muscles of the shoulder, forearm, and wrist customarily used in playing tennis, comprising a single elongated flexible and elastic cord having a loop at one end through which an arm may be extended and a handle of elongated shape having a bore through which the flexible and elastic cord passes to vary the length of the cord between the loop and the handle and to secure the handle in a selected position.

5 Claims, 5 Drawing Figures

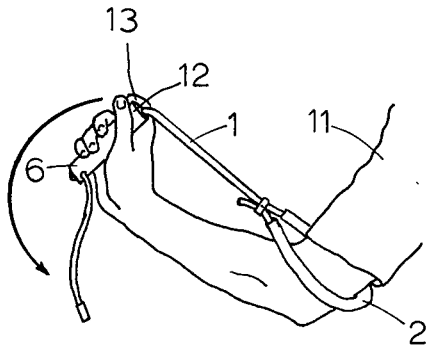
FIG. 3
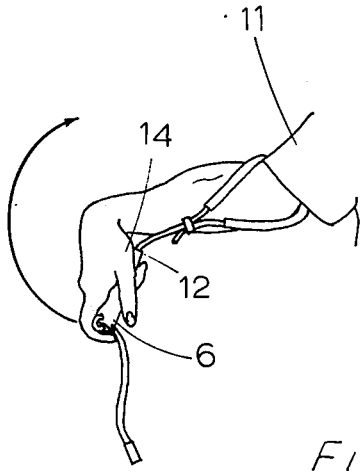
FIG. 4
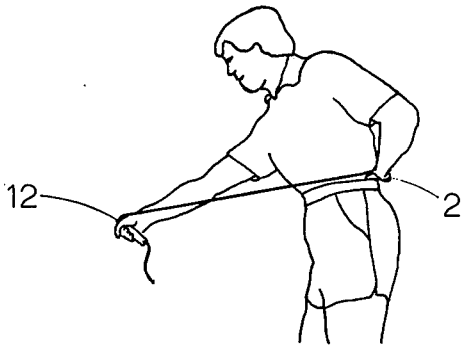

ADJUSTABLE ELASTIC TYPE EXERCISING DEVICE

SUMMARY OF THE INVENTION

My invention relates to the physical development art and, more particularly, to an elastic type exercising device which may be carried on the person of an individual or in a compact carrying case, for strengthening and developing the muscles of the arms and limbs, and more especially those associated with playing tennis.

My device, as more particularly described herein, is extremely effective for the purpose in question in that the exercises performed in connection therewith duplicate the forces applied to the muscles during the execution of tennis strokes. Moreover, the muscles of the user are not only flexed but are also extended and stretched in such a manner as to strengthen the same.

My device may be used by the exerciser without requiring the cooperation of another person or a fixed point to which the device must be attached or anchored as needed in some prior art devices. Moreover, it is relatively light and sufficiently compact to be carried on the person in a pocket or carrying case, so that it will be readily available at all times. The simple construction of my device insures that the necessary adjustments may be made rapidly with a minimum of effort, and it is relatively inexpensive compared with many of the prior art exercising devices. The rugged and simple construction of the device described herein is extremely durable resulting in a unit which will render effective service over a relatively long period of time.

A broad object of my invention is to provide a simple but effective exerciser of relatively low cost, completely portable, and perfectly safe. The manner in which these results are achieved will be apparent to those who are familiar with and accustomed to using devices of the type in question, as described in detail in the following specification.

BRIEF DESCRIPTION OF THE DRAWINGS

FIGS. 3, 4, and 5 are illustrative views showing basic, preferred exercising motions undertaken in the utilization of the device.

DETAILED DESCRIPTION OF THE DEVICE

Figure 1:
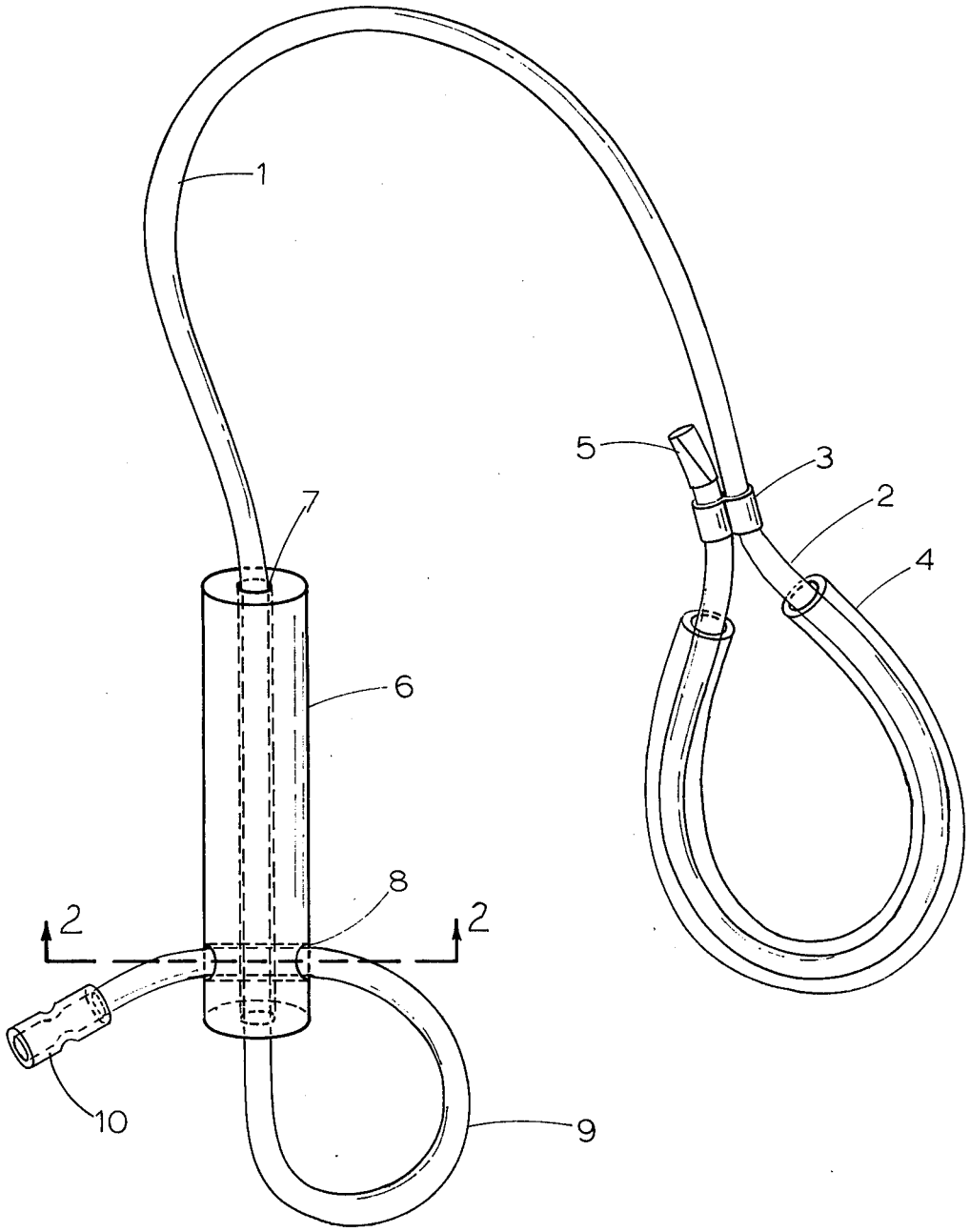
FIG. 1 is a front elevational view showing a preferred embodiment of the invention.

Referring to FIG. 1, it will be seen that the components making up a preferred embodiment of the invention include a sturdy elastic cord 1, which may be of highly elastic strands of rubber enclosed in a woven nylon casing; a loop 2 at one end of the cord formed by doubling the cord back on itself and securely adjoining by means of a crimped metal band 3; a clear, soft plastic tube 4 through which the cord of the loop is inserted to provide padding; a piece of tape 5 wrapped around the loop end of the cord to prevent fraying; an elongated handle 6, which may be made of wood, with bores 7 and 8 through which the cord is threaded to form loop 9; and a crimped metal ferrule 10.

Figure 2:
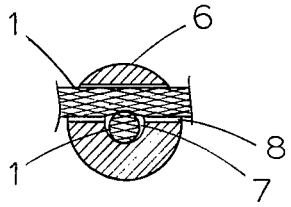
FIG. 2 is a sectional view of the adjusting means taken along line 2-2 of FIG. 1.

Referring to the sectional view of FIG. 2 it is seen that while bores 7 and 8 are larger than the diameter of the cord 1 and provide a slip fit; they are located such that cord 1 is caused to bind slightly on itself at the point of intersection.

Now it will be obvious that the length of cord between the handle 6 and the loop 2 may be adjusted simply by pulling or pushing on the slack cord of loop 9. It will also be obvious that when the slack is pulled out of loop 9, the cord length between handle 6 and loop 2 is set and that tension between handle 6 and loop 2 wil not cause further slipping of the cord.

Therefore it is seen that the handle 6 with its particular location of bores 7 and 8, and with the cord 1 threaded as shown; does provide a quick, easy, and effective means of adjusting and holding the length of cord between the handle 6 and loop 2.

Attention is now directed to FIGS. 3, 4, and 5 which show three of the basic and preferred exercises which may be done with the device. In FIG. 3 the arm 11 is extended through loop 2 and the handle 6 is gripped with the nose end 12 over the inside knuckle of the forefinger 13. The cord length is adjusted so that the cord 1 is just barely taut when the wrist is bent all the way back. From this position the wrist is slowly bent downward in the direction of the arrow. As the cord adjustment is fixed, the cord 1 must stretch during this motion. This causes the tension in the cord and hence the forces on the muscles to increase. When the downward movement is completed the wrist is slowly brought back to the original position. The exercise is repeated a number of times to suit the individual. This exercise is especially good for the muscles of the wrist used in the serving motion of tennis and for the forearm muscles used in the forehand stroke.

The exercise of FIG. 4 is performed again with the arm 11 extended through the loop 2 but with handle 6 gripped such that the nose end 12 is under the palm of the hand. Here the cord tension is adjusted to be just barely taut when the wrist is bent all the way down as shown. From this position the wrist is slowly bent upwards in the direction of the arrow, then returned to the original position, and then repeated a suitable number of times. This exercise is strengthening to the particular forearm muscles exerted in the backhand stroke of tennis.

In FIG. 5 the device is held as shown with the loop 2 held behind the back with one hand and the handle 6 gripped with the other hand with the nose end 12 pointing away from the body. The cord is adjusted taut as shown and the arm is pivoted in a horizontal plane from the shoulder. This exercise is especially good for the shoulder. This exercise is especially good for the shoulder muscles.

Having described a preferred embodiment of my invention it is obvious that various changes in the shape, size and arrangement of parts may be made without departing from the spirit of the invention, or the scope of the appended claims.

Having described the invention, I claim:

1. An elastic exercising device for developing and strengthening the wrist, arm, and shoulder muscles, particularly those associated with playing tennis, comprising: a single elastic cord, the ends of which are encased to prevent fraying; a padded loop in one end of the cord through which an arm may be extended; a handle of elongated shape having through which the cord passes to vary the length of the cord between the loop and the handle and to secure the handle in a fixed selected position.

2. A device in accordance with claim 1 in which the end of the cord forming the loop is attached to the cord at the base of the loop by a crimped metal band.

3. A device in accordance with claim 1 in which the cord of the loop is inserted through a soft, flexible, plastic tube.

4. A device in accordance with claim 1 in which the elongated handle has a central bore extending therethrough of a diameter to provide a sliding fit with the cord, a transverse bore of substantially the same diameter located off-center in said handle, the end of the cord opposite the arm receiving loop end being threaded through the central bore and then through the transverse bore, the sliding fit of the cord in the two bores permitting the handle to be slipped along the cord and secure the same in a selected position.

5. A device in accordance with claim 4 in which the central and transverse bores in the handle intersect at an angle.

* * * * *